US005493737A

United States Patent [19]

Chu

[11] Patent Number: 5,493,737

[45] Date of Patent: Feb. 27, 1996

[54] TOILET APPARATUS WITH DEVICE FOR DEODORIZATION

[76] Inventor: Kung-Ming Chu, No. 19, Lane 270, Alley 36, Sec. 4, An Ho Rd., Tainan, Taiwan

[21] Appl. No.: 313,873

[22] Filed: Sep. 28, 1994

[51] Int. Cl.[6] ..... E03D 9/052

[52] U.S. Cl. ..... 4/213

[58] Field of Search ..... 4/209 R, 209 FF, 4/213

[56] References Cited

U.S. PATENT DOCUMENTS 3,605,126 9/1971 Henry ..... 4/209 FF X

FOREIGN PATENT DOCUMENTS 0197724 8/1991 Japan ..... 4/209 R

*Primary Examiner*—Charles E. Phillips

*Attorney, Agent, or Firm*—Morton J. Rosenberg; David I. Klein

[57] ABSTRACT

A toilet apparatus having a device for deodorizing a toilet is provided. The device includes a housing, a cover for the housing, a base for mounting the housing on the toilet water tank, a pump disposed in the water tub, and a sensing unit. The housing comprises a mist sprayer positioned at a top portion thereof adjacent an inlet for gas from the toilet, a first partition member disposed at one side of the mist sprayer adapted to block the water sprayed, and a second partition member spaced from the first partition to form a pair of chambers. The second partition member has a notch formed therein which allows air flow from the first chamber to the second chamber. The first chamber has the mist sprayer, a guiding media, and an activated carbon box therein. The second chamber has a gas exhauster which has a gas outlet conduit disposed at a bottom portion and extending through the base. The base is seated on top of the toilet water tank. The sensing unit is controlled by an infrared sensor to activate the gas exhauster and the pump responsive to detection of a human being in proximity thereof.

1 Claim, 3 Drawing Sheets

TOILET APPARATUS WITH DEVICE FOR DEODORIZATION

FIELD OF THE INVENTION

This invention relates to a toilet apparatus, and more particularly, to a toilet apparatus to remove bad odors from the toilet.

BACKGROUND OF THE INVENTION

A good sanitary environment is a basic requirement pursued by modern families. A restroom is one of the places where bad odors originate from, especially after someone has used it. The odor sometimes will take hours before it dissipates.

SUMMARY OF THE INVENTION

It is the primary object of the present invention to provide a toilet apparatus with a device for deodorization which is capable of removing bad odors coming from a toilet.

It is another object of the present invention to provide a toilet apparatus with a device for deodorization having a filter which is easy to replace.

It is a further object of the present invention to provide a toilet apparatus with a device for deodorization which is inexpensive to manufacture.

DETAILED DESCRIPTION OF THE PREFERRED, EMBODIMENT

Figure 1:
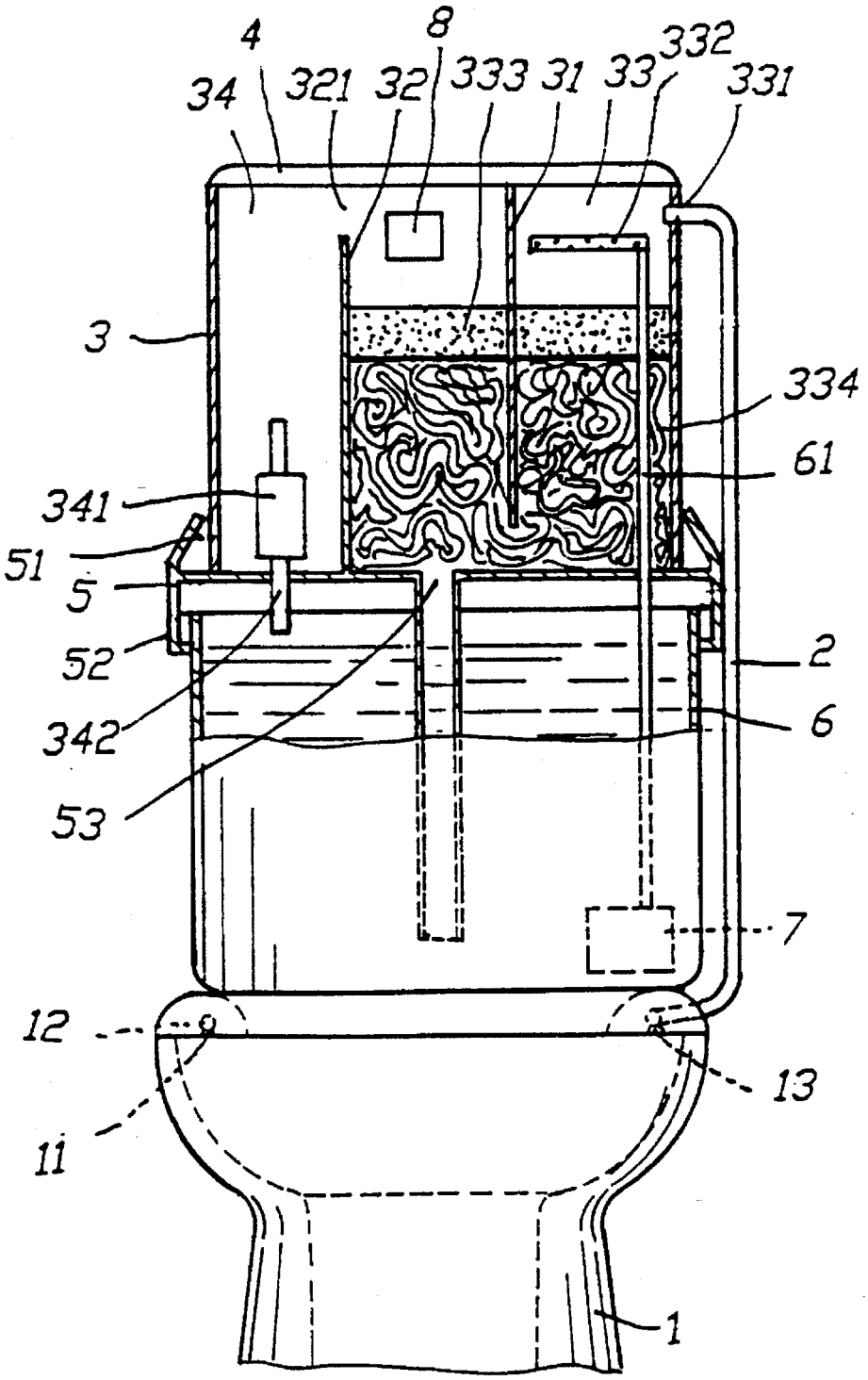
FIG. 1 is an elevation view, partially sectioned, of a toilet apparatus, according to the present invention installed on a toilet.

Referring to FIG. 1, there is shown, a toilet bowl 1, a gas inlet conduit 2, a housing 3, a cover 4, a base 5, a water tank 6, a pump 7, and a sensing unit 8.

The toilet bowl 1 has a gas outlet 11 which draws in odor laden gas from the bowl to the housing 3 through the gas inlet conduit 2.

The housing 3 includes a first and a second partition 31 and 32, the first partition being located centrally between one end of the housing 3 and the second partition 32, the partition 32 defining a first and a second chamber 33 and 34. The first chamber 33 includes a mist sprayer 332 disposed on one side of the first partition 31. The second partition 32 has a notch 321 formed at a top portion thereof to allow gas flow therethrough. The first chamber 33 defines a filter chamber having an aperture 331 formed through the housing 3 adapted to receive one end of the conduit 2 which is inserted therein. The mist sprayer 332 is positioned at the top portion of filter chamber 33 and has one end connected to the water tank 6 through a conduit 61 and pump 7. An activated carbon box 333 is disposed underneath the mist sprayer 332, to filter the gas flowing from the gas inlet conduit 2. Guiding media 334 is disposed beneath the activated carbon box for guiding the water and gas and permitting separation thereof. The second chamber 34 includes a gas exhauster 341 which has a gas outlet conduit 342 at bottom portion and extending through the base 5, so that gas will be blown out of the housing 3 through the gas outlet conduit 342.

The cover 4 is adapted to seal the housing 3 at a top portion thereof.

Figure 2:
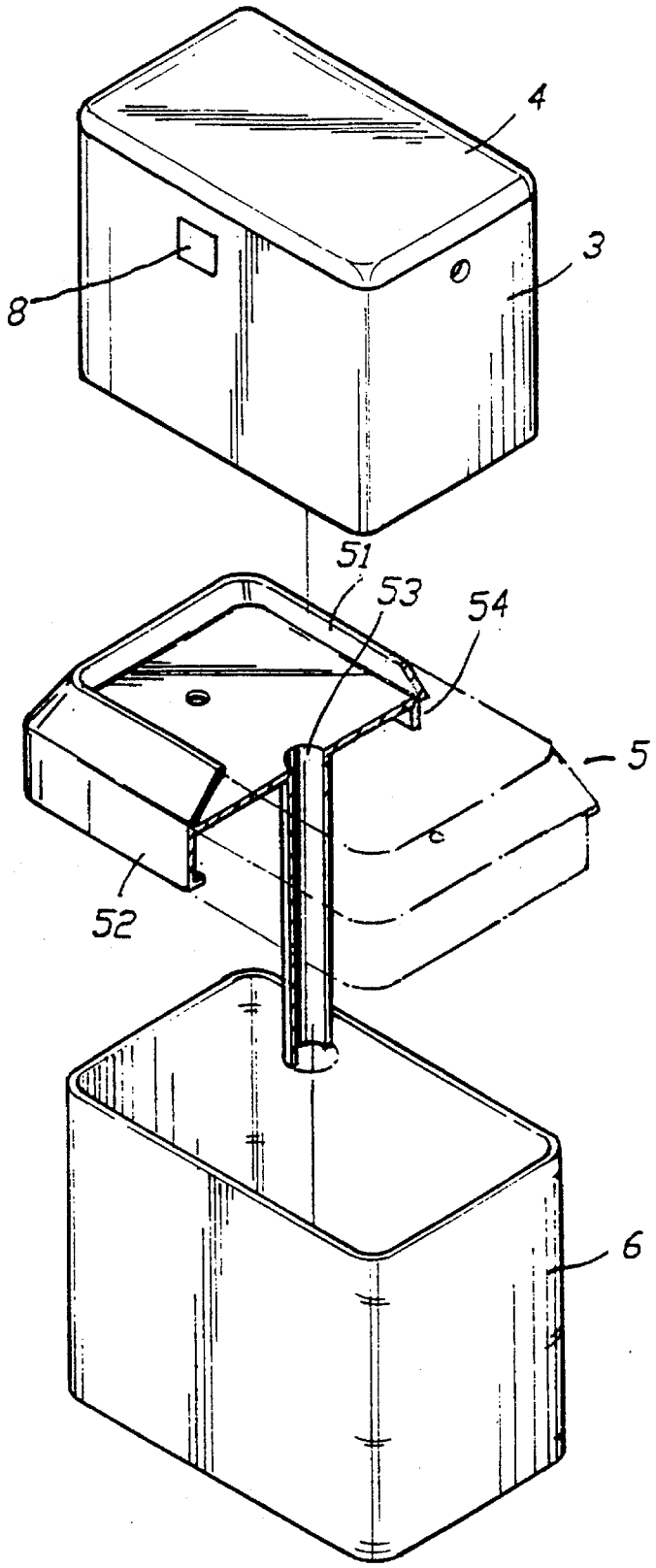
FIG. 2 is an exploded view, partially sectioned, of the present invention.

The base 5 is wider than the water tank 6 and the housing 3, but the housing 3 is bonded securely to the top of the base 6. The two ends of the base 5 have extending therefrom a pair of clips 52 adapted to secure the base 5 on the water tank 6. The clips 52 are adapted to fit water tanks 6, each being formed in one of several different sizes for mating with water tanks of different sizes. A water outlet 53 is formed at bottom portion of the base 5 adapted to drain water passing from the sprayer 332, activated carbon box 333 and guiding media 334 into the water tank 6. A gas outlet 54 is formed in a lower portion of the base 5, as shown in FIGS. 2 and 3B, adapted for air to flow Outwardly from the water tank 6.

The pump 7 is located in the water tank 6 and adapted to pump water into the housing 3 through the sprayer 332. The water spray contacts and mixes with the gas from inlet conduit 2, both then passing through the activated carbon to remove odor causing constituents thereof.

The sensing unit 8 is located in the housing 3, and is connected to the gas exhauster 341 and the pump 7. The sensing unit 8 is connected to the gas exhauster 341 and the pump 7 through an electric cord. The sensing unit 8 includes an infrared sensor which is adapted to detect human body temperature and responsive thereto sends a signal to activate the gas exhauster 341 and the pump 7. The sensing unit 8 deactivates the gas exhauster 341 and the pump 7 when the infrared sensor no longer detects a human body temperature.

Figure 3A:
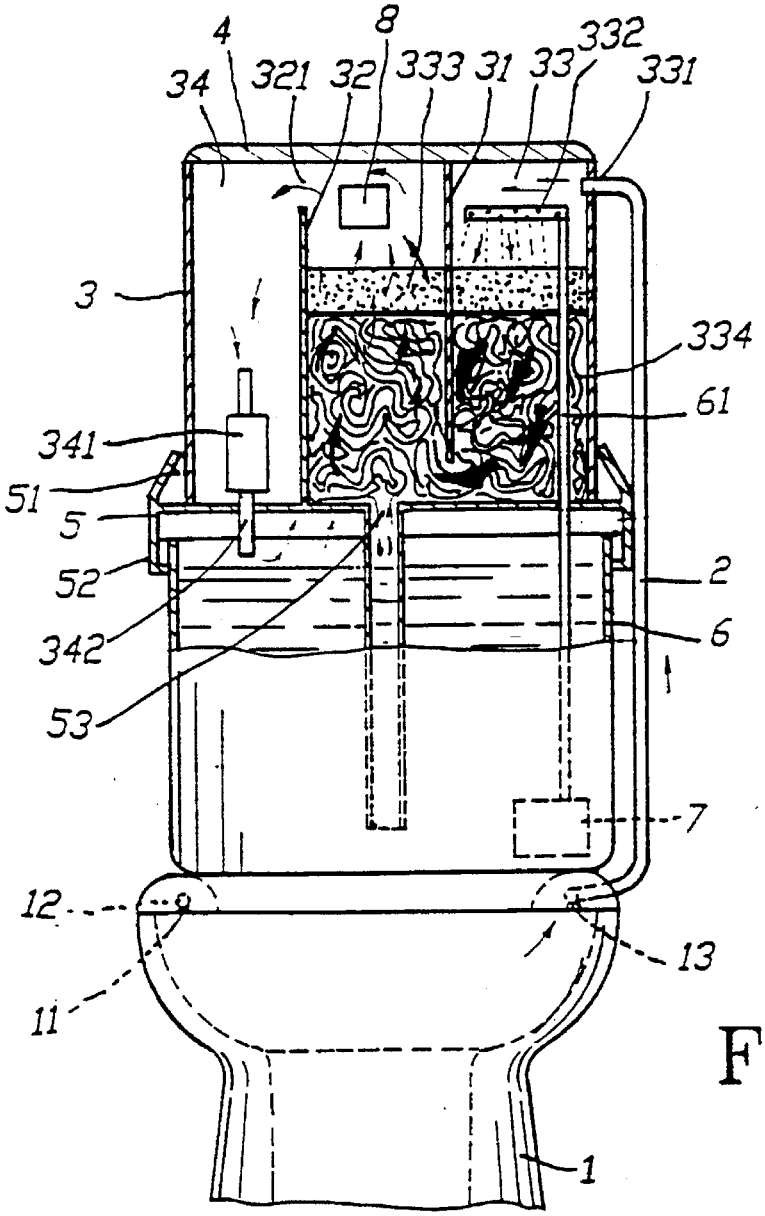
FIG. 3A is an elevation view, partially sectioned, of the present invention showing the gas flow path by arrows.
Figure 3B:
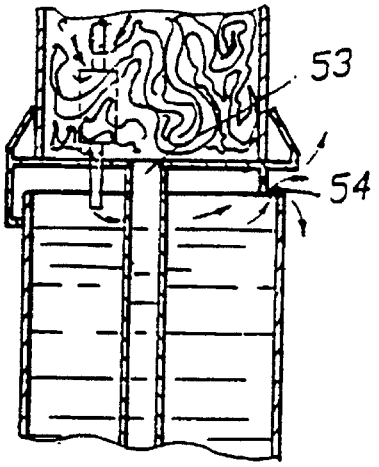
FIG. 3B is a cut-away end view of the present invention showing the gas flow path by arrows.

Upon sensing a human body temperature, as shown in FIGS. 3A and 3B, the sensing unit 8 will activate the pump 7 and the gas exhauster 341. The pump 7 will pump water out from the mist sprayer 332 to mix with the gas entering housing 3. The gas then flows with the water through the activated carbon box 333 and the guiding media 334, the deodorized gas being blown out through the gas exhauster 341 out into the base 5. The gas being output from the gas exhauster 341 has become deodorized by its contact with the water spray and passage through the activated carbon filter.

In order to continue removing bad odors resulting from the toilet, it is only necessary to periodically exchange the active carbon box 333.

I claim:

1. A device disposed on a toilet's water tank for deodorizing the toilet's bowl, comprising:

a base member overlaying a top portion of the toilet's water tank, said base member having a gas outlet formed in a lower portion thereof for passage of gas from an interior portion of the water tank, said base member having a planar bottom wall extending across an upper edge of the water tank, said bottom wall having a through opening formed therein and a centrally disposed water outlet formed therethrough;

a housing formed by a pair of opposing side walls and a pair of opposing end walls coupled to an upper surface of said base member bottom wall, one of said end walls having an aperture formed therethrough adjacent an upper edge of said housing, said housing having a first and second partition disposed in spaced parallel relation therein, said second partition being spaced from said one end wall and dividing said housing into first and second chambers, said second partition having a notched opening formed therein for passage of gas from said first chamber to said second chamber, said first partition dividing said first chamber into first and second portions and being spaced from said base member bottom wall for passage of water and gas from said first portion to said second portion of said first chamber;

a cover overlying said housing for forming a closure therefore;

an inlet conduit having a first end disposed in proximity to the toilet's bowl and an opposing second end coupled to said housing end wall aperture for transferring gas from the toilet's bowl to said first portion of said first chamber;

a pump disposed in the toilet's water tank, said pump having an outlet conduit extending through said housing for pumping water thereto responsive to an electrical signal;

an air exhauster disposed in said second chamber for drawing gas through said inlet conduit and through said first chamber responsive to said electrical signal, said air exhauster having a gas outlet conduit extending through said base member bottom wall through opening for exhausting gas to the interior of the toilet's water tank;

a water sprayer disposed in said first portion of said first chamber adjacent said housing end wall aperture coupled in fluid communication with said pump outlet conduit for spraying water into a gas flow from said inlet conduit;

a activated carbon filter box disposed below said water sprayer within said first chamber for removing odor causing constituents from gas and water passing therethrough;

guiding media disposed below said activated filter box within said first chamber for guiding water and gas from said first portion of said first chamber to said second portion thereof, the water passing to said water outlet and the gas passing to said notched opening of said second partition; and, a sensing unit coupled to said pump and said air exhauster for output of said electrical signal responsive to detection of a person in proximity to the toilet, said sensing unit being mounted on said housing and including an infrared sensor for detecting persons in proximity thereto.

* * * * *